United States Patent [19]

Day

[11] 4,182,095

[45] Jan. 8, 1980

[54] PACKAGING BULK COMMODITIES

[76] Inventor: Timothy T. Day, 197 Vallance Rd., Bethnal Green, London, England

[21] Appl. No.: 906,383

[22] Filed: May 16, 1978

Related U.S. Application Data

[62] Division of Ser. No. 782,087, Mar. 28, 1977, Pat. No. 4,132,048.

[30] Foreign Application Priority Data

Mar. 29, 1976 [GB] United Kingdom ..... 12594/76

[51] Int. Cl.[2] ..... B65B 31/02

[52] U.S. Cl. ..... 53/86; 53/512; 53/557

[58] Field of Search ..... 53/512, 511, 557, 434, 53/433, 86

[56] References Cited

U.S. PATENT DOCUMENTS

| | | | |
|---|---|---|---|
| 3,956,867 | 5/1976 | Utz et al. | 53/433 |
| 3,958,391 | 5/1976 | Kujuby | 53/512 X |

*Primary Examiner*—Travis S. McGehee

*Attorney, Agent, or Firm*—Karl W. Flocks

[57] ABSTRACT

A process for packaging bulk commodities such as meat comprises vacuum sealing the commodity into a bag of plastics material and then causing the material of the bag to expand by a further reduction in pressure of the environment surrounding the bag. The material expands into contact with heaters which heat the material and when the environment surrounding the bag is returned to normal pressure, the material closely encloses the commodity.

8 Claims, 5 Drawing Figures

PACKAGING BULK COMMODITIES

This is a division of application Ser. No. 782,087, filed Mar. 28, 1977 U.S. Pat. No. 4,132,048.

BACKGROUND OF THE INVENTION

This invention relates to a process and apparatus for packing bulk commodities, such as carcases or parts of carcases of animals, and other foodstuffs, in vacuum packs for distribution for example to the wholesale food distributors.

In packing foodstuffs for example in this manner the operator places the product such as a part of an animal's carcass into a premade bag of sealable plastics material and the loaded bag is placed into the sealing apparatus. This apparatus comprises a platform or indexing conveyor disposed on a suitable frame or stand with a removable lid or hood which is usually hinged to one side of the tray opposite to the loading position, and a sealing bar is disposed across the tray adjacent to the loading position. When the loaded bag is laid in the platform or conveyor the operator disposes the mouth of the bag over the sealing bar and the hood is closed. A second sealing bar is mounted on the hood so that when the hood is closed the hood sealing bar engages the mouth of the bag and through the bag mates with the platform or conveyor sealing bar. Reduced pressure is applied to the chamber so that the bag is under vacuum of usually about 4 Torr and the electric current is supplied to the sealing bars thus sealing the bag as by impulse sealing under reduced pressure. The closed chamber is then ventilated and the lid is opened so that the sealed pack can be transported to a station for further processing or storage. The hood is preferably actuated as by calibrated springs which urge it into the open position and the current to the sealing bars is cut off at the same time.

In this process there is the problem that at the end of the operation leaks in the packs may occur at the seal so that air enters the packed bags through an imperfect seal which leads to a number of packs being rejected. This is an expensive wastage.

It is known to use a bag of shrinkable plastics material and then the unsealed bag with the commodity in it is placed in a dip tank filled with water usually at about 100° C. although it is not necessary for this water to boil. At this temperature the bag shrinks onto the commodity and the shrunken bag is put in the vacuum sealing apparatus.

The main object of the present invention is to provide an improved process and apparatus suitable for packing bulk food products and other commodities in which the aforesaid disadvantages are minimised and also to provide improved bulk packs produced by this process.

SUMMARY

According to the present invention a process of packing bulk commodities into vacuum sealed plastics bags comprises loading a commodity to be packed into a bag of plastics material, disposing the loaded bag into a sealing apparatus, closing the sealing apparatus with the superposed films at the open mouth of the bag disposed in a sealing device and the outer surface of the bag engageable with a heating device, energising the apparatus to apply reduced pressure to the bag interior, heat or impulse sealing the mouth of the bag, further reducing the pressure in the apparatus to cause the material to contact heating means, heating the material with the heating means, and allowing the interior of the apparatus to return to normal pressure conditions whereby the plastics material closely encloses the commodity.

The plastics material may be a shrink-plastics material or a laminate of two films of different softening points; in the latter case, heating of the material causes the inner laminar to soften and fuse around the commodity on release of the reduced pressure.

Preferably the heating device comprises a number of heating elements each mounted on a support connected to a piston element in a cylinder element connected to a source of fluid pressure of higher value than the reduced pressure applied to the closed sealing apparatus whereby on application of the reduced pressure to the closed apparatus the pressure differential applied to the cylinder will cause the piston element to move in the cylinder element to urge the heating elements into engagement with the loaded bag in the apparatus.

According to another aspect of the invention an apparatus for packing bulk commodities into vacuum sealed packs comprises a lower closure member to receive a loaded plastics bag, a lid or hood member to close the closure member, a sealing device disposed when the lid or hood is closed on the closure member to engage the mouth of the loaded bag, and a heating device in the closed closure members, an apparatus to apply a reduced pressure to the closed closure member, and operable to engage the bag subjected to the reduced pressure to heat the bag to its inner softening temperature to cause the bag to collapse onto the load under action of the reduced pressure and to fuse round the load in the bag.

BRIEF DESCRIPTION OF THE DRAWINGS

FIG. 2 is a diagrammatic cross-section on the line II—II of FIG. 1; and, FIG. 3 is a plan view of FIGS. 1 and 2 showing the interior of the sealing apparatus with the lid or hood shown in full lines in the closed position, and in the accompanying drawings, in which:

In the drawings the same references are used to designate the same or similar parts.

DESCRIPTION OF THE PREFERRED EMBODIMENTS

Figure 1:
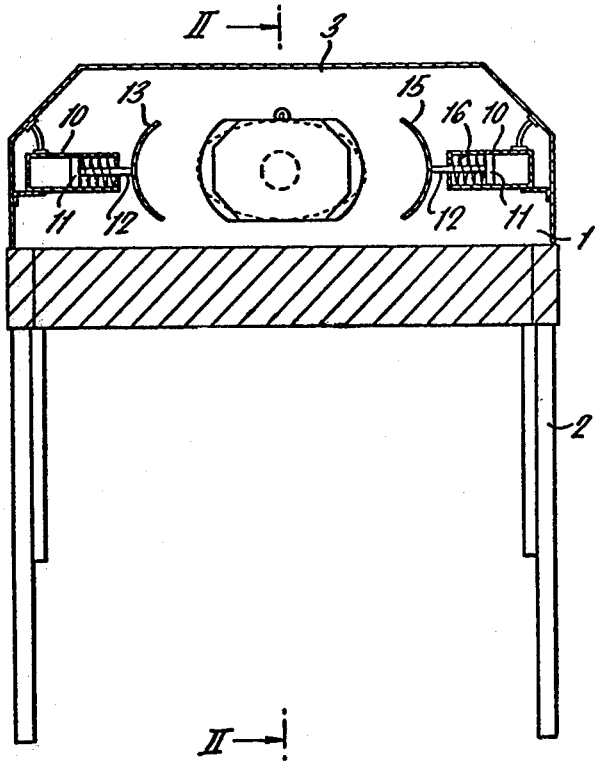
FIG. 1 is a diagrammatic cross-section on the line I—I in FIG. 2 of a bag sealing apparatus.
Figure 3:
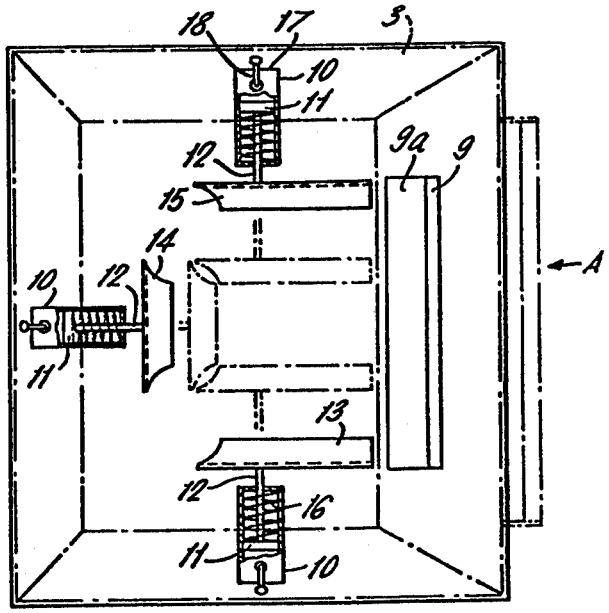
Figure 2:
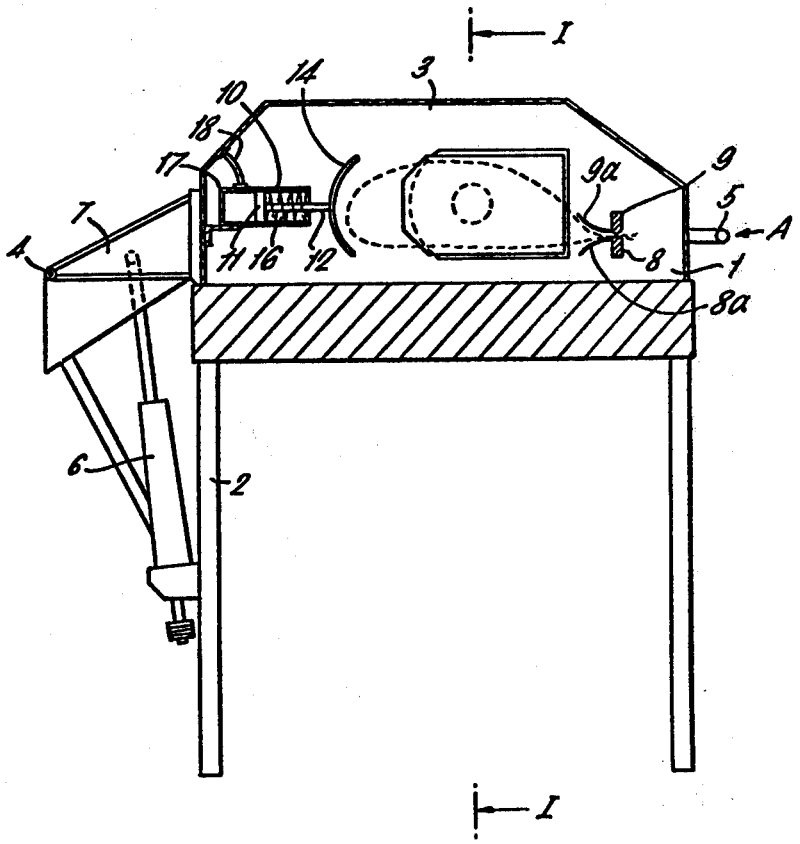

Referring to FIGS. 1 to 3, these show diagrammatically an apparatus for sealing bags, loaded with a commodity such as a part of the carcass of an animal, e.g. a hind quarter of bacon. The apparatus and the process using it to seal the bags under vacuum may however be used to pack any bulk commodity which may be food or any other article such as a piece of machinery.

The apparatus has a tray 1 mounted on a suitable frame 2 with a lid or hood 3 hinged at 4 to one side of the tray, a handle 5 being provided to close the lid or hood. A spring or pneumatic or hydraulic device 6 is coupled between the frame 2, or the tray itself, and a bracket 7 on the hood to raise the hood. The handle 5 is used by the operator to close the hood and the hood is held in the closed position by the reduced pressure applied to the interior of the apparatus against the action of the device 6. The device 6 is calibrated so that when the reduced pressure in the apparatus is released the device 6 will exert itself and open the hood.

Within the tray is a sealing element 8 normally, as shown, in the form of a bar extending across the loading position A of the tray while a second sealing element 9 is disposed in the hood so that when the hood is closed its sealing device 9 mates or comes into register with the sealing device 8. Curved permanently heated plates 8*a*, 9*a* are associated with the sealing devices 8,9 respectively to shape and seal the part of the bag adjacent to the mouth.

Also within the tray are cylinder elements 10 within which slide piston elements 11 having connecting rods 12 extending out of the cylinder element and carrying heating elements 13,14,15. Within each cylinder element is a spring 16 urging the piston elements away from the bag supporting position in the apparatus. The closed end 17 of each cylinder element is connected through a duct 18 to the ambient atmosphere or other pressure source.

Three heating elements supported on piston elements 11 are provided one at each side of the bag in the sealing position and one at the back of the bag i.e. the part closest to the hood hinge 4. The elements 13,14,15 are shaped to engage snugly over the major portion of the outer surface of the bag.

In operation the operator loads a load into an open bag of plastics film laminate, e.g. of nylon-polythene, the inner ply of the bag having a lower softening point than the outer ply. The loaded bag is then disposed in the tray with its open mouth on the tray sealing bar 8 and the operator closes the hood and actuates the means (not shown but of conventional construction) to apply the reduced pressure e.g. 4 Torr, to the interior of the apparatus. Th reduced pressure overcomes the spring or like device 6 to maintain the hood on the tray in a fluid tight seal. A pad or like known means may be secured to the rim of the tray or the hood to effect a fluid tight seal when the hood is in the closed position.

The reduced pressure within the apparatus creates a pressure differential on opposite sides of the piston elements 11 thus causing the heating elements 13,14,15 to move into engagement with the outer surface of the bag. The sealing elements 8, 9 and the plates 8*a*, 9*a* are energized to heat or impulse seal the mouth of the bag, and after this sealing is accomplished, the pressure in the apparatus continues to be reduced. The reduced pressure within the bag creates a pressure differential on opposite sides of the bag causing the bag to expand to engage the elements 13,14,15 this providing good surface contact of the bag with the heaters to assist in the softening of the inner ply of the bag material.

The heating elements 13,14,15 heat the bag to soften the interior of the bag material so that as the bag collapses onto the load therein the bag material fuses round the load in close contact therewith.

The machine control circuiting automatically releases the reduced pressure in the apparatus and this causes further collapse of the bag; the springs 11 cause the heating elements to retract from the bag and the spring or the like 6 raises the hood. The sealed loaded bag is them removed from the tray and the apparatus is then set for a new cycle of operations.

Figure 4:
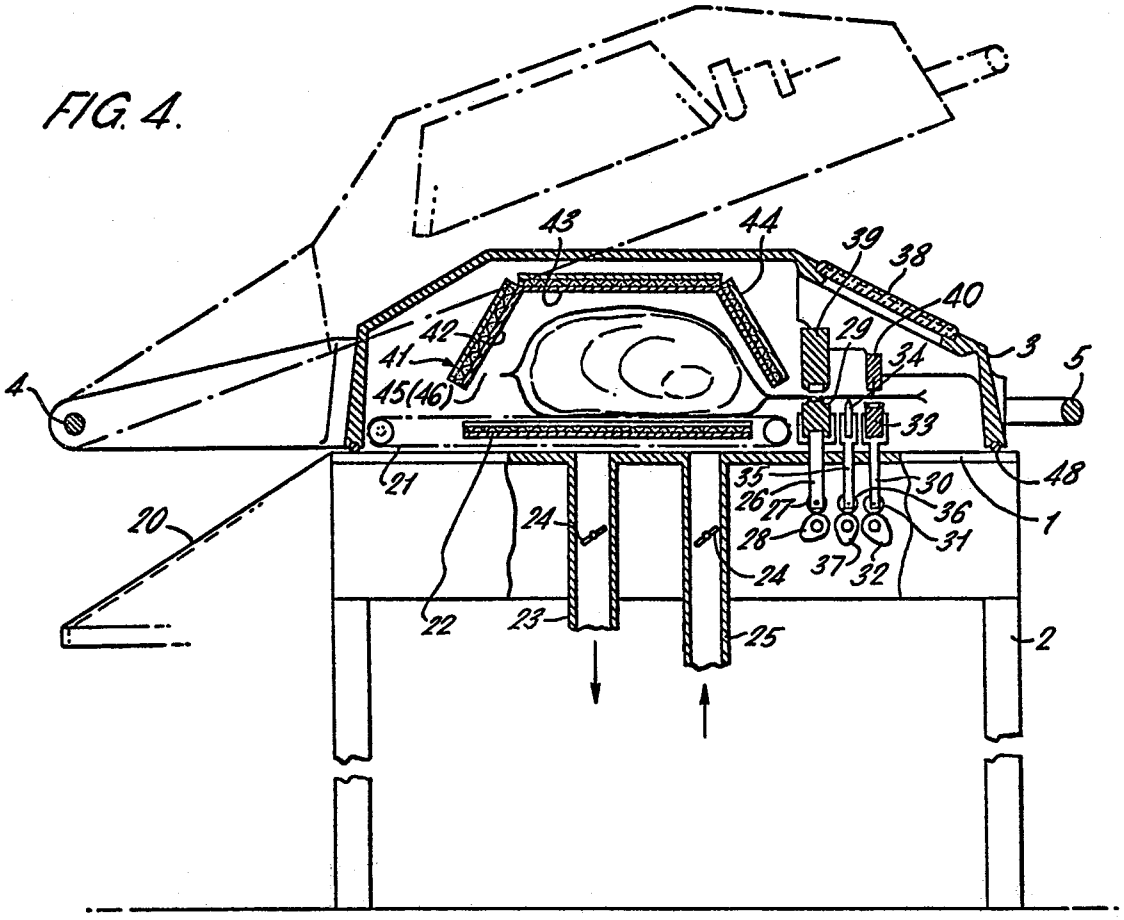
FIG. 4 is a diagrammatic cross-section on the line IV—IV of FIG. 5 of another form of bag sealing apparatus.
Figure 5:
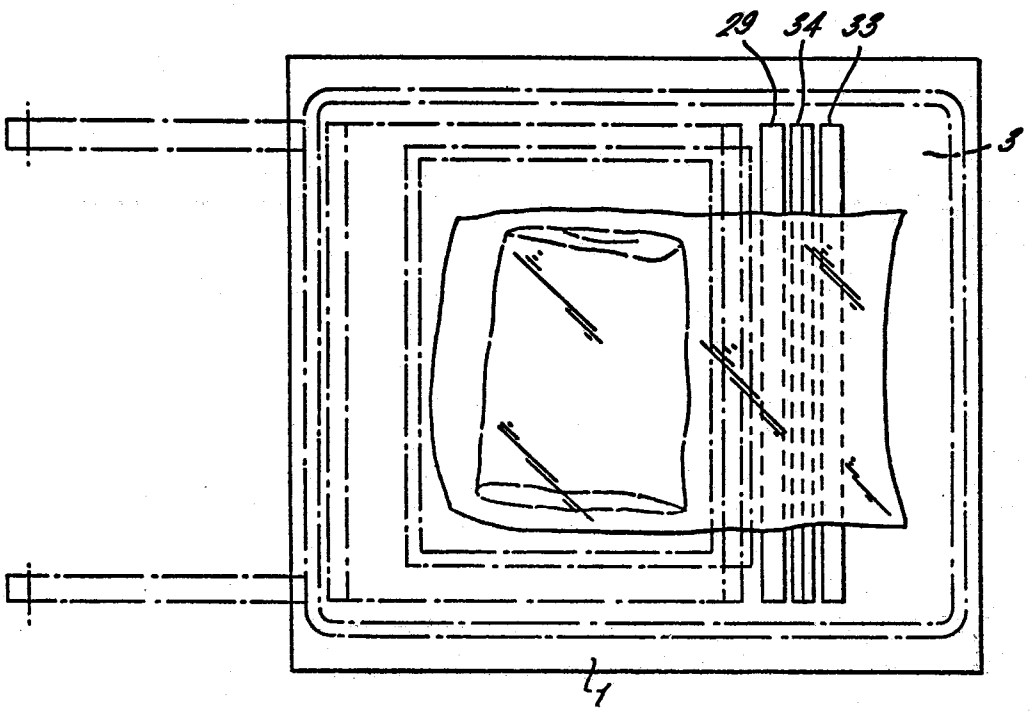
FIG. 5 is a cross-section on the line V—V in FIG. 4.

Referring to FIGS. 4 and 5 these show diagrammatically another from of bag sealing apparatus having, as in the apparatus of FIGS. 1 to 3, a tray 1 on a frame 2, a hood 3 hinged at 4 to the frame, and a handle 5.

At the rear of the tray is a discharge chute 20 to receive the sealed loaded bags and within the tray is a belt conveyor 21 on which the loaded bag to be sealed is loaded, and which when the apparatus is opened after a sealing operation will convey the sealed bag to the chute. The conveyor is an endless belt of heat resistant material, preferably an open mesh material. Within the upper and lower reaches of the belt is a heater device 22 preferably in mat form as in and of similar material to the heater mats of FIGS. 1 to 3.

In the bottom of the tray is an outlet 23, with a flow control device shown as a butterfly valve 24, adapted to be connected to a source of reduced pressure whereby a vacuum may be applied to the interior of the closed apparatus. An air inlet 25, also having a control valve shown as a throttle 24, is provided in the tray to restore the apparatus interior to atmospheric or at least appropriate atmospheric pressure as required.

Towards the front of the apparatus, to the right in FIGS. 4 and 5, there is a reciprocable rod 26 adjacent the front end of the conveyor with a cam follower 27 engaging by gravity or by a spring (not shown) a rotary cam 28. The upper end of this rod supports a lower impulse seal bar 29. To the front of the bar 29 and spaced therefrom is a vertically reciprocable rod 30, with a cam follower 31 engaging a cam 32 and supporting a lower gripper bar 33. Between the bars 29 and 33 is a cutter device shown as a knife 34 on a vertically reciprocable rod 35 with a cam follower 36 engaging a rotary cam 37.

The hood 3 has a window 38 to enable the operator to watch the sealing operation and carries an upper impulse sealer bar 39, mating when the hood is closed with the bar 29, and an upper gripper bar 40 mating similarly with the bar 33.

Mounted on the interior of the hood is an upper heating device 41 of similar material to the heater device 22 and disposed as five sections 42,43,44,45 and 46 (four sides and top) to cap over the loaded bag so that with the device 22 all faces of the loaded bag will be substantially heated uniformly as will be described. This heater device may consist only of three panels (two sides and top) with heater means in them if desired. The periphery of the hood is provided with a seal 48.

The conveyor belt, switching devices of conventional form, and the cams are all actuated by conventional drive means in timed relation to the closing and opening of the hood from any suitable power operated means such as timed gearing actuated by a prime mover (e.g. and electric motor not shown) under the control of the operator who also loads loaded packs to be sealed onto the stationary conveyor 21.

The operation of the apparatus of FIGS. 4 and 5 is as follows. With the hood open the operator loads a loaded but unsealed pack onto the stationary conveyor 21 with the open unsealed end of the bag disposed over the bars 29 and 33 which with the cutter 34 are in the lowered inoperative position. The hood is closed to form a fluid-tight seal round the upper peripheral rim of the tray. The air inlet 25 by the valve 24 and the vacuum pump of conventional design is actuated to evacuate air from the interior of the apparatus through the outlet 23.

When the vacuum in the apparatus reaches a predetermined level e.g. 4 Torr, the drive motor is automatically operated, causing the cam 28 to lift the bar 29 and causing the cam 32 to raise the gripper bar 33 at the same time energising the bar 29 to heat or impulse seal the open mouth of the bag.

The heating of the bar 29 is then terminated and the bar 33 is raised by its cam 32; the bag is thus gripped by the bars 29, 33, so that when the cutter 28 is then raised between the bars it cuts off the spare bag material. The bar 33 is then allowed to fall following its cam.

At this stage although the heaters are energised they are out of contact with the material of the bag and the commodity such as a piece of bulk meat is still cold. However, continued reduction of pressure in the enclosure after sealing of the bag causes the bag to expand into contact with the heaters which heat the bag material to its shrink temperature. The vacuum outlet is closed and the air inlet is opened to allow air to flow at a predetermined controlled rate into the apparatus. This causes a pressure build up in the apparatus with a result that the bag deflates at the same rate, or substantially so, as the heat causes the bag material to shrink to a maximum amount before it touches the commodity at maximum deflation. The heaters are then de-energised.

The hood is then opened, the conveyor is put into operation to remove the sealed bag onto the chute and the apparatus is then set for a new cycle of sealing operation.

A suitable plastics laminate film or sheet is a nylon polythene laminate widely on the market having a nylon thickness of 30 microns with a softening point of 240° C. and the polythene being 70 microns thick with a softening point of 115° C. A lower melting point polythene of 70 microns thickness with a softening point of 105° C. may be used.

The heater elements are preferably in the form of thin flexible mats, formed of an electrically resistant film or mesh embedded in a thin film of plastics material and which may have their heating faces covered with a glass impregnated polytetrafluoroethylene film about 3–5 thousandths of an inch thick. This film may be adhesive backed to adhere to the mat or it may be fixed to the mat in any other conventional manner. Any suitable heating plates may be used. The heating elements may be heated electrically or they may be heated by a heated fluid passing through ducts therein supplied with a heating fluid e.g. steam from an external source.

Where the plastics material of the bags is a shrink plastic material this will operate as herein described in the vacuum packing apparatus and on heating the film will collapse closely round the load in the bag.

By means of the invention bulk vacuum packs are produced which by complete fusing of the opposing films round the load in the bag the commodities are packed in a leakproof manner.

It will be appreciated that conventional shrink plastics material may be used in place of the laminate described. It will further be appreciated that the method may be carried out in separate vacuum and heating chambers, e.g. the product may be vacuum-packed using conventional equipment and then passed to an evacuating and heating chamber where further application of vacuum to the environment surrounding the sealed pack causes expansion of the plastic material into contact with heaters which can supply heat to the shrinkable material in its expanded condition without this heat being conducted away by the cold product. Release of the vacuum then causes the softened and/or shrinkable packaging material to closely envelope the commodity.

I claim:

1. An apparatus suitable for packing bulk commodities into vacuum sealed plastic bags made of a laminate material formed of two films of plastic material of different softening points comprising a lower closure member to receive a loaded bag of said plastic laminate, a lid or hood member to close said closure member and form a chamber, heat sealing means disposed when said chamber is closed to engage the mouth of the loaded bag, heating means in said chamber and disposed out of contact with an unsealed loaded bag in said chamber, evacuation means to apply reduced pressure to the interior of said chamber and to the interior of said loaded bag, means to actuate said heat sealing means to seal said evacuated loaded bag, means to maintain operation of said evacuation means to cause said sealed bag to expand towards said heating means to soften the inner laminate of the plastic film of the material of said bag, and means to create a positive pressure in said chamber to cause said bag to collapse on the commodity in said bag and to make intimate surface contact with said commodity, said heating means urged by resilient means towards the expanding loaded sealed bag when said hood member is closed onto said lower closure member.

2. An apparatus according to claim 1, wherein the heating means comprise mats of electrically resistant material embedded in a film or sheet of plastics material.

3. An apparatus according to claim 1, wherein the heating means are covered by a film or sheet of plastics material coated with glass impregnated polytetrafluoroethylene film preferably about 3–5 thousandths of an inch thick.

4. An apparatus according to claim 1, wherein the heating means are backed with an adhesive material to adhere to a mat.

5. An apparatus suitable for packing bulk commodities into vacuum sealed plastic bags made of a laminate material formed of two films of plastic material of different softening points comprising a lower closure member to receive a loaded bag of said plastic laminate, a lid or hood member to close said closure member and form a chamber, heat sealing means disposed when said chamber is closed to engage the mouth of the loaded bag, heating means in said chamber and disposed out of contact with an unsealed loaded bag in said chamber, evacuation means to apply reduced pressure to the interior of said chamber and to the interior of said loaded bag, means to actuate said heat sealing means to seal said evacuated loaded bag, means to maintain operation of said evacuation means to cause said sealed bag to expand towards said heating means to soften the inner laminate of the plastic film of the material of said bag, and means to create a positive pressure in said chamber to cause said bag to collapse on the commodity in said bag and to make intimate surface contact with said commodity, said lower closure member including a tray to receive the loaded bag to be sealed, said heating means disposed on said tray and capable of heating a number of faces of the bag in said tray, said hood member hinged or otherwise suitably articulated with respect to the periphery of said tray, and mating sealing bars provided one on said hood member and the other on said tray to engage and grip the open portion of the loaded bag in said tray when said hood member is closed onto said tray, said heating means urged by resilient means towards the expanding loaded sealed bag on said tray when said hood member is closed onto said tray.

6. An apparatus according to claim 5, wherein an inlet and outlet are provided by which vacuum may be applied to the interior of the chamber when the hood member is closed on the tray and the pressure within the closed chamber may be increased to return the closed chamber to atmospheric pressure prior to removing the hood member from the tray.

7. An apparatus suitable for packing bulk commodities into vacuum sealed plastic bags made of a laminate material formed of two films of plastic material of different softening points comprising a lower closure member to receive a loaded bag of said plastic laminate, a lid or hood member to close said closure member and form a chamber, heat sealing means disposed when said chamber is closed to engage the mouth of the loaded bag, heating means in said chamber and disposed out of contact with an unsealed loaded bag in said chamber, evacuation means to apply reduced pressure to the interior of said chamber and to the interior of said loaded bag, means to actuate said heat sealing means to seal said evacuated loaded bag, means to maintain operation of said evacuation means to cause said sealed bag to expand towards said heating means to soften the inner laminate of the plastic film of the material of said bag, and means to create a positive pressure in said chamber to cause said bag to collapse on the commodity in said bag and to make intimate surface contact with said commodity, said lower closure member including a tray to receive the loaded bag to be sealed, said heating means disposed on said tray and capable of heating a number of faces of the bag in said tray, said hood member hinged or otherwise suitably articulated with respect to the periphery of the tray, and mating sealing bars provided one on said hood member and the other on said tray to engage and grip the open portion of the loaded bag in said tray when said hood member is closed onto said tray, said hood member supporting an upper sealing bar adjacent to the loaded bag in said tray, and an upper gripper element remote from the bag and said tray supporting a lower sealing bar, a cutter, and a lower gripper element all vertically reciprocable within said tray and mating respectively with said upper sealing bar and the upper gripper bar when said hood member is closed, the vertical reciprocable bar, cutter and gripper bar all being vertically reciprocable by cam operated means capable of being actuated in timed relation.

8. An apparatus according to claim 7 wherein said upper and lower sealing bars are impulse heaters.

* * * * *